United States Patent [19]

Choi et al.

[11] 4,401,554

[45] Aug. 30, 1983

[54] SPLIT STREAM REFORMING

[75] Inventors: Byung C. Choi, Cherry Hill; Kenneth R. Graziani, Woodbury, both of N.J.

[73] Assignee: Mobil Oil Corporation, New York, N.Y.

[21] Appl. No.: 396,977

[22] Filed: Jul. 9, 1982

[51] Int. Cl.[3] ..... C10G 35/04

[52] U.S. Cl. ..... 208/64; 208/65; 208/79

[58] Field of Search ..... 208/64, 65, 79

[56] References Cited

U.S. PATENT DOCUMENTS 2,990,363 6/1961 Evans ..... 208/64

*Primary Examiner*—Curtis R. Davis

*Attorney, Agent, or Firm*—Alexander J. McKillop; Michael G. Gilman; Charles J. Speciale

[57] ABSTRACT

A reformate richer in BTX content than the reformate obtained from the conventional catalytic reformation of a wide cut naphtha is obtained by splitting the naphtha into two fractions, catalytically reforming the heavy fraction sequentially through a series of at least three catalyst beds and introducing the light fraction into the feed to the last or the penultimate reactor.

12 Claims, 2 Drawing Figures

SPLIT STREAM REFORMING

BACKGROUND OF THE INVENTION

1. Field of the Invention

This invention relates to the catalytic reforming of naphtha. More particularly, it relates to the catalytic reforming of light and heavy fractions of naphtha. This invention especially relates to the fractionation of naphtha and the catalytic reforming of the several fractions in a fashion which provides an increased BTX yield.

2. Description of the Prior Art

The art of reforming naphtha hydrocarbons boiling in the gasoline boiling range has been practiced in one form or another for many years. Over these years the reforming process has developed to include regenerative and semi-regenerative operations in combination with operations wherein the total naphtha charge is passed sequentially through a plurarity of separate catalyst beds or separate fractions thereof are passed through one or more beds of reforming catalyst under conditions of operating temperature, pressure and space velocity considered most suitable for achieving desired reforming reactions. More recently reforming processes have been developed where the catalyst is regenerated continously.

When hydrocarbons boiling in the gasoline boiling range come in contact with the dual functional catalysts employed in reforming, a number of reactions takes place which include dehydrogenation of cycloparaffins to form aromatics, dehydrocyclization of paraffins to form aromatics, isomerization reactions and hydrocracking reactions. A typical dual functional catalyst contains a metallic hydrogenation-dehydrogenation catalyst, typically 0.1 to 1.0 weight % Pt which is dispersed on an oxide, acidic catalyst such as alumina. These bring about dehydrogenation and isomerization of saturated parraffins. When the reforming conditions are quite severe, coke formation in the catalyst occurs with consequent deactivation of the catalyst. Thus, it is quite apparent that the composition of the naphtha charge will necessarily influence the severity of the reforming conditions employed to produce a desired product. However, the reforming operations, as we know them today, have certain built in limits because of reaction kinetics, catalysts available and equipment to perform the reforming operation. With the advent of unleaded gasoline requirements a renewed interest has been generated to further adapt the reforming operation of the production of high octane unleaded reformate gasoline product.

The reforming art has suggested splitting a wide-boiling range petroleum fraction, often a full range or wide cut naphtha (100–430° F.), into a lighter cut and a heavier cut and separately reforming the two cuts using optimium operating conditions to provide a particularly useful reformate. Such a split feed reforming process is disclosed in U.S. Pat. Nos. 3,432,425 of Bodkin et al., 3,753,891 of Graven et al. and 4,002,555 of Farnham et al. In all three of these processes the light fractions and heavy fractions are separately reformed in parallel fashion although each fraction may be processed in a series of catalytic reactors. Bodkin et al. reforms the light fraction under more severe conditions then the heavy fraction while Graven et al. employs the opposite concept. Farnham uses a cascade hydrogen system so that the heavy fraction is reformed at a higher pressure than the light fraction.

Although the naphtha feed is split into two fractions in U.S. Pat. No. 3,647,679 of Kirk, Jr. et al., parallel reforming is not employed. Rather, the light naphtha is catalytically reformed serially in a number of reactors with the heavy fraction added to the feed entering the last reactor in the series. The light fraction has a boiling range below about 390° F. while heavy fraction boils in the range of about 390° to about 415° F. The process is said to upgrade heavy naphtha without excessive coke formation and to provide an increased amount of reformate of increased octane.

It is sometimes required to provide a reformate having particularly desirable properties for a special use or a reformate of a specifically useful composition, such as a reformate enriched in a benzene-toluene-xylene (BTX) fraction. This BTX fraction serves as the feedstock for a host of petrochemicals which are eventually transformed into fabrics, resins, molded products, films and a variety of other household and commercial products. U.S. Pat. No. 4,222,854 of Vorhis, Jr. et al. discloses a reforming process for the production of motor gasoline and BTX-enriched reformate by fractionating a naphtha feedstock into a mid-boiling BTX-precursor fraction, a high-boiling fraction and a low-boiling fraction. The BTX-precursor fraction is catalytically reformed in a first reforming zone to provide the BTX-enriched reformate while the high-boiling and low-boiling fractions are combined and catalytically reformed in a second reforming zone to provide motor gasoline.

It is an object of this invention to provide a reformate enriched in BTX content.

It is another object of this invention to provide an improvement in a conventional reforming process wherein the reformate will have a higher BTX content than is obtained in conventional naphtha reforming.

It is a further object of this invention to provide a reformate having an enhanced BTX composition utilizing conventional reforming catalysts, equipment and operating conditions.

The achievement of these and other objects will be apparent from the following description of the subject invention.

SUMMARY OF THE INVENTION

In accordance with the present invention, it has been found that a reformate enriched in BTX content can be provided by splitting the naphtha feed into two fractions, catalytically reforming the heavy fraction in serial fashion in at least three catalyst beds and introducing the light fraction into the feed to the last or penultimate reactor.

In particular this invention relates to a process for improving the BTX composition when reforming naphtha boiling range hydrocarbons which comprises:

(a) separating a naphtha into a low boiling fraction and a high boiling fraction, (b) contacting said high boiling fraction sequentially with a reforming catalyst situated in at least three reforming catalyst zones under effective reforming conditions and in the presence of hydrogen, (c) introducing the low boiling fraction as part of the feed to the last or the penultimate of the reforming catalyst zones, and (d) recovering from said last reforming catalyst zone a product effluent having a BTX composition substantially higher than if said naphtha were catalytically reformed with substantially the same catalyst under substantially the same reforming conditions.

DESCRIPTION OF THE PREFERRED EMBODIMENTS

Figure 1:
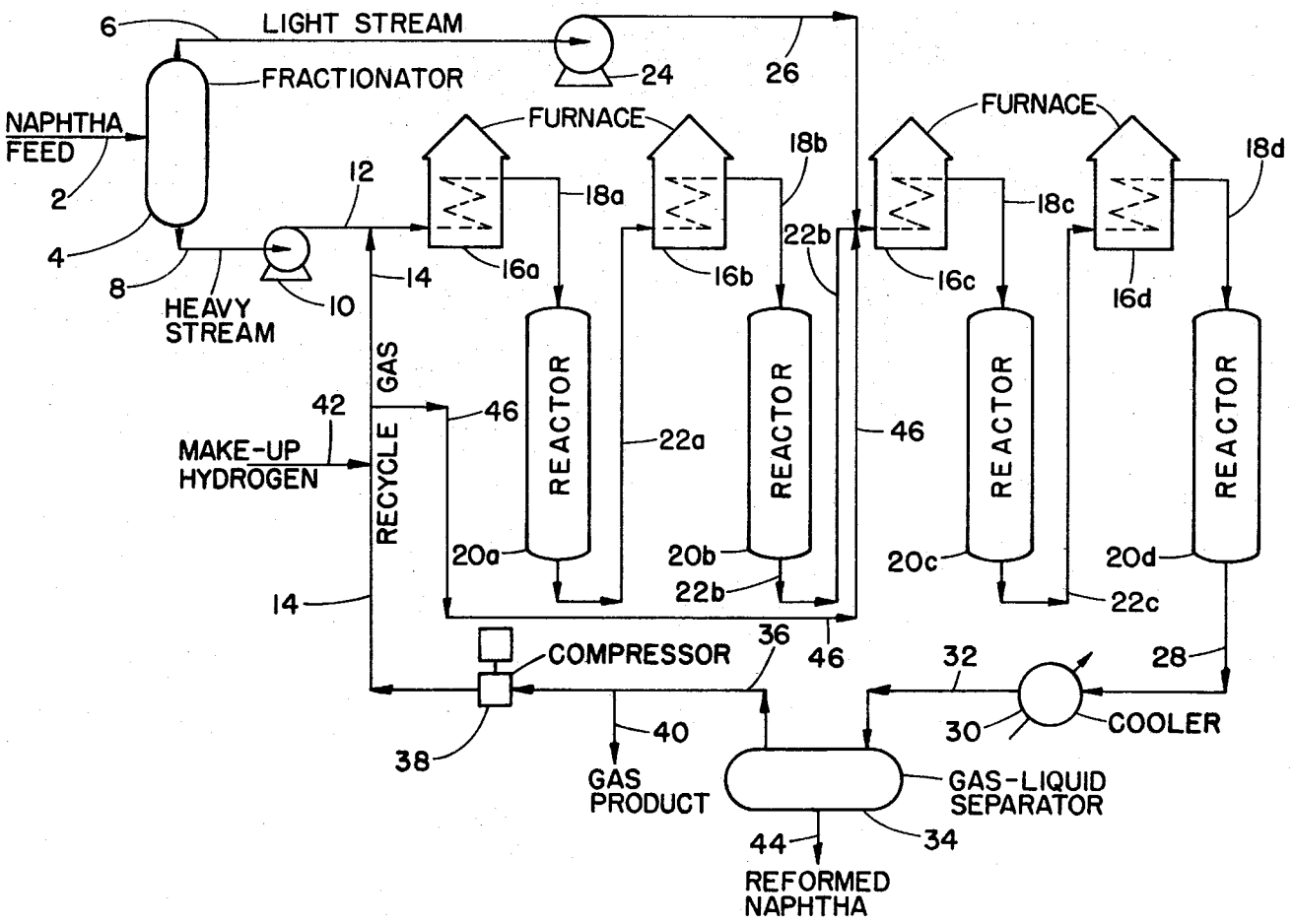
FIG. 1 is a schematic flowplan of an embodiment of the invention.

The present process relates to a reforming process for converting a naphtha to a more useful product. In particular, the reforming process is operated in a fashion to improve the BTX yield in the reformate over that obtained in conventional reforming of a full range naphtha. The improvements of this invention are achieved by employing a split feed. The naphtha is split into a heavy fraction and a light fraction with the heavy fraction subjected to reforming in a conventional multi-reactor catalytic reforming unit. The light fraction is introduced along with the effluent from the prior reactor into a later reactor, the last or the penultimate in the series of at least three reactors. The improvement in BTX yield is at the expense of $C_9+$ aromatics. The improvement obtained when practicing this invention is not specific to a particular reforming catalyst or a particular reformer configuration. Similar advantages can be expected from any commercially available reforming catalyst as well as from both fixed bed and moving bed systems.

The hydrocarbon feed or naphtha charge to be processed by the method of this invention comprises a mixture of hydrocarbons boiling in the range of from about $C_5$ hydrocarbons up to about 430° F. end point i.e., a boiling range of about 100° to about 430° F. This boiling range includes naphthas in a light and heavy gasoline boiling range. The feed may be a straight run naphtha, a thermally cracked naphtha, a catalytically cracked naphtha, a hydrocrackate or blends thereof.

The naphtha feed must be split into a low boiling (light) fraction and a high boiling (heavy) fraction when practicing this invention. The feed is separated into the desired fractions by conventional means, such as fractionation. The cut point range for the naphtha should be between about 200° to about 350° F. Preferably, the cut point is substantially the mid-boiling point of the naphtha. For example, with a 125°–390° F. naphtha, the light fraction could boil from about 125° to about 250° F. while its companion heavy fraction could boil from about 225° to about 390° F.

The reforming proccess with which this invention is sucessfully employed is generally carried out in a plurality of interconnected and sequentially arranged reaction zones under conditions selected to promote dehydrogenation, dehydrocyclization and isomerization of at least $C_5+$ hydrocarbons to higher octane products.

At least three catalytic reaction zones are employed in the process of this invention although four reaction zones are preferred. Five or more catalytic reaction zones may be employed but are seldom found to be economically attractive. The catalyst may be present as a fixed or moving bed, the particular type being often determined by the frequency and nature of the catalyst regeneration. However, the beneficial results achieved by the process of the invention are not specific to the type of catalyst bed or regeneration technique employed.

Suitable reforming conditions include reforming temperatures in the range of from about 800° F. to about 1000° F. and more usually temperatures of at least 850° F. The reforming pressure employed may be as high as about 1000 p.s.i.g., however, it is preferred to employ lower operating pressures for economic reasons in the order of about 500 p.s.i.g. or lower. Pressures as low as 100 p.s.i.g. may be employed to advantage in some operations. Liquid hourly space velocities of the reactants may also be varied over a relatively wide range of from about 0.1 up to about 10 but usually not substantially greater than about 4. In general, it is preferred to maintain an excess of hydrogen in combination with the naphtha being reformed so that the mole ratio of hydrogen to hydrocarbon charge employed may be in the range of from about 1 to about 20, preferably from about 4 to about 12.

The catalyst employed in the reforming reaction zones may be selected from a number of known reforming catalysts of the prior art which include for example, a catalyst comprising alumina in the eta or gamma form or mixtures thereof in combination with a noble metal. Platinum series metals such as platinum, palladium, osmium, irridium, ruthenium, or rhodium deposited on a suitable support comprising alumina is preferred. Generally, the alumina comprises a major portion of the catalyst and may comprise 95% by weight or more of the catalyst. It is contemplated, however, combining other components with the alumina such as the oxides of silica, magnesium, zirconium, thorium, vanadium, titanium, boron or mixtures thereof. In another embodiment the plantinum-alumina complex either with or without one or more of the above components such as silica etc. may also be promoted with small amounts of halogen such as chlorine or fluorine in amounts ranging from about 0.1% up to about 3% by weight. Metal promoters such as rhenium, tin, iridium, etc. in amounts ranging from 0.01 to 5% by weight may also be employed. However, in a preferred embodiment the reforming catalyst carrier material is preferably a high surfaced area material, primarily gamma alumina material of at least 200 and preferably 300 or more square meters per gram. This alumina carrier material is impregnated with a platinum type hydrogenating component described above in amounts ranging up to about 1% by weight but generally, not substantially over about 0.6% by weight. This catalyst may also be promoted with one or more of the other catalyst components above described and known in the art. A particularly preferred catalyst is composed of platinum and rhenium on an alumina support.

It is to be understood that a naturally occurring or synthetically prepared alumina with or without silica may be employed as a carrier material or support for the platinum type hydrogenating component. Preferably, the platinum-alumina catalyst employed comprises a high surface area material such as an eta or gamma base alumina discussed above. Before use, the catalyst is reduced in a hydrogen atmosphere under conditions to maintain the catalyst in a relatively dry moisture free atmosphere before being put on-stream since it has been found that at a given moisture and certain related temperature level that a relationship exists which decreases the surface area and has a simultaneous deactivating effect on the catalyst. Accordingly, it is preferred to employ in the reforming step of this invention, relatively dry reforming conditions and this is particularly true when employing relatively low pressure reforming conditions.

In the practice of this invention the heavy naphtha fraction passes through the entire sequence of catalytic reforming reactors while the light fraction only is processed in the last or the last two reactors in the series. The heavy stream contacts the reforming catalyst for a much longer period than the light stream. Hence, at a given severity the degree of reforming reaction for the heavy fraction is much higher than the light fraction. As compared to conventional reforming of a wide cut naphtha, the process of this invention results in a higher conversion of feed to heavy aromatics due to the combination of longer contact time and improved reformability of the heavy stream. It is thought that the heavy aromatics undergo further dealkylation reactions, which results in an improved BTX yield.

Having provided a general discussion of the process of this invention, reference is made to FIG. 1 which depicts a flowplan of an embodiment of the invention. A wide-cut straight run naphtha having a boiling range of about 125°–390° F. is passed through line 2 to fractionator 4. The naphtha is split in fractionator 4 into a light naphtha fraction having a boiling range of about 125°–250° F. which passes from the top of the fractionator through line 6 and a heavy naphtha fraction having a boiling range of about 225°–390° F. which passes from the bottom of the fractionator through line 8. The heavy naphtha is then conveyed to the multi-reactor reforming unit by pump 10 and line 12. Recycle hydrogen from line 14 is combined with the heavy naphtha in line 12.

The reforming unit consists of a series of four furnaces, 16*a*, 16*b*, 16*c* and 16*d*, four fixed bed reactors, 20*a*, 20*b*, 20*c* and 20*d*, piping 18*a*, 18*b*, 18*c* and 18*d*, conducting the reaction mixture from each furnace to its corresponding reactor and piping 22*a*, 22*b* and 22*c*, conducting the reactor effluent from each reactor to the next downstream furnace. Each reactor contains a fixed bed of reforming catalyst, platinum-rhenium on alumina or some other suitable reforming catalyst. The heavy naphtha is passed through reactors 20*a*, 20*b*, 20*c* and 20*d* in serial fashion under effective reforming conditions. Typically, the heavy naphtha passes through furnace 16*a*, line 18*a*, reactor 20*a* and line 22*a*. The latter delivers the reaction mixture to the next reactor in line.

Returning to the light naphtha recovered from fractionator 4 through line 6, this stream is conveyed by pump 24 and line 26 to line 22*b* which is conducting the effluent from the second reactor (reactor 20*b*) to the third furnace (furnace 16*c*). The light naphtha is combined with the effluent stream from the second reactor 20*b*. The combined mixture is then passed through the final two reactors (reactors 20*e* and 20*d*) under effective reforming conditions. Where the light naphtha is of a quality which does not require as much reforming as is provided by the last two reactors of the reforming unit, it may be combined with the reaction mixture in line 22*c* so as to only pass through the last furnace and the last reactor thereby only being reformed to the extent provided by reactor 20*d*.

The total product from the reforming unit is then passed by line 28 to cooler 30. From the cooler it is passed by line 32 to separator 34. In separator 34, hydrogen-rich gaseous material is separated from the reformed naphtha product and withdrawn through line 36 for recycling to reactor 20*a* by means of compressor 38. This hydrogen rich stream supplies hydrogen required for reforming. A portion of the gaseous material may be removed from line 36 through line 40 and make-up hydrogen may be added through line 42 to maintain the required hydrogen quality. The reformed naphtha product, having a significantly enhanced BTX content, is recovered from separator 34 through line 44.

In an optional embodiment which further improves the BTX yield, the recycle hydrogen gas is split with a portion of it supplied through line 14 to the feed to the first reactor 20*a* and a portion of it supplied through line 46 to the feed to the third reactor 20*c*. The feed to the third reactor is the effluent from the second reactor 20*b* plus the light naphtha stream. The split hydrogen recycle scheme will result in a lower average partial pressure thereby further improving BTX yield. However, this advantage is obtained at the expense of somewhat shorter reformer cycle length.

The following example illustrates the practice of this invention.

A kinetic model of a fixed bed reforming unit was employed to demonstrate the practice of this invention as compared to the conventional reforming of a wide cut straight run naphtha. In this computer simulation a first portion of a wide cut naphtha was split into a light fraction and a heavy fraction. The properties of the straight run naphtha and the light and heavy fractions thereof are shown in Table 1 below. The reforming unit employed in this simulation was a four reactor fixed bed reforming unit employing a catalyst of platinum-rhenium supported on gamma-alumina. The catalyst loading per bed and the operating conditions are shown in Table 2 below. In the computer simulation, operation A was a conventional reforming process where the entire wide cut naphtha was introduced into reactor no. 1 and reformed sequentially in the four reactors. In operation B, the reforming process, in accordance with the subject invention, was employed where the heavy fraction was introduced into reactor no. 1. and the light fraction was introduced into reactor no. 3 (this is the operation shown in FIG. 1 and discussed herein above).

Two evaluations were made, one at a reformate octane (R+O) level of 96 and other at 98 octane. The yield analysis for these four runs is shown in Table 3 below. The advantages of operating a reforming unit in accordance with the subject invention are clearly evident. At the 96 octane level the BTX yield for the conventional process is 29.9% by weight while for the process of the invention it is 32.4% by weight. Similarly, at the 98 octane level, the conventional process BTX yield is 32.1% by weight compared to 34.3% by weight for the process of the invention.

TABLE 1

| | FEED PROPERTIES | | |
|---|---|---|---|
| | WIDE CUT NAPHTHA | LIGHT FRACTION | HEAVY FRACTION |
| Specific Gravity | 0.7349 | 0.696 | 0.763 |
| Paraffins, wt % | 68.5 | 80.3 | 60.9 |
| Naphthenes, wt % | 18.7 | 15.6 | 20.8 |
| Aromatics, wt % | 12.8 | 4.1 | 18.3 |
| ASTM, D-86 | | | |
| IBP | 167 | 139 | 257 |
| 10 | 195 | 158 | 278 |
| 30 | 228 | 172 | 289 |
| 50 | 265 | 185 | 299 |
| 70 | 295 | 205 | 314 |
| 90 | 331 | 234 | 341 |
| EP | 376 | 256 | 384 |

TABLE 2

| OPERATING CONDITIONS | | |
|---|---|---|
| OPERATION | A | B |
| No. of Reactors | 4 | 4 |
| Catalyst | Pt—Re on Alumina | Pt—Re on Alumina |
| Catalyst Loading, Vol % | | |
| RX 1 | 9.5 | 9.5 |
| RX 2 | 25 | 25 |
| Rx 3 | 30 | 30 |
| Rx 4 | 30 | 30 |
| Reactor Pressure, psia | 350 | 350 |
| Recycle Ratio, Overall | 8.0 | 8.0 |
| Lt Stream Inlet | 1st | 3rd |
| LHSV, OVERALL | 1.5 | 1.5 |
| Mol % Lt in Feed | 42 | 42 |

Note:
A - conventional reforming process
B - reforming process of invention

TABLE 3

| OPERATION | A | B | A | B |
|---|---|---|---|---|
| OCTANE (R + O) | ← 96 → | | ← 98 → | |
| Yield | | | | |
| Benzene, wt % | 2.5 | 2.6 | 2.9 | 2.9 |
| Toluene, wt | 9.4 | 9.7 | 10.5 | 10.7 |
| Xylene, wt | 18.0 | 20.1 | 18.7 | 20.7 |
| Total BTX, wt % | 29.9 | 32.4 | 32.1 | 34.3 |
| Total Arom., wt % | 45.7 | 45.8 | 47.7 | 47.6 |

Note:
A - Conventional reforming process
B - Reforming process of invention

Figure 2:
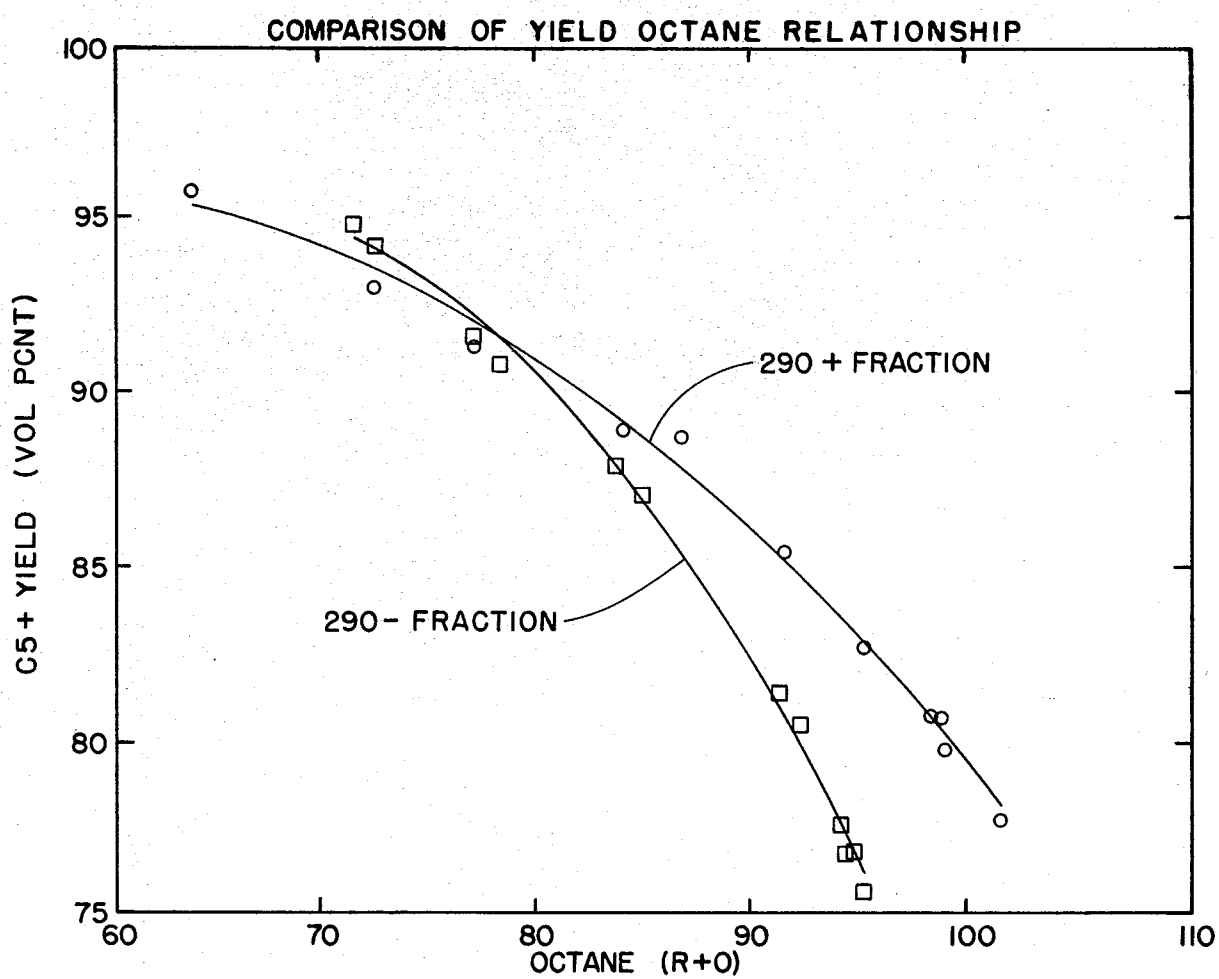
FIG. 2 is a graph of the relationship between reformate octane and $C_5+$ yield for a light naphtha fraction and a heavy naphtha fraction catalytically reformed in accordance with conventional reforming art.

FIG. 2 presents the relationship between $C_5+$ yield and octane (R+O) for the light naphtha (290−° F.) and the heavy naphtha (290+° F.) catalytically reformed in accordance with conventional reforming scheme. The yield-octane relationship of both streams indicates that the decline in yield for the heavy stream, as the reformate octane increases, is much smaller than that for the light stream. Thus the difference in yield selectivity between the two streams is throught to be the reason why higher BTX yield is obtained when practicing the process of this invention. Also, this difference in yield selectivity may be further exploited to achieve higher reformate yield.

What is claimed is:

1. A process for improving the BTX composition when reforming naphtha boiling hydrocarbons which comprises:
   (a) separating a naphtha into a low boiling fraction and a high boiling fraction,
   (b) contacting said high boiling fraction sequentially with a reforming catalyst situated in at least three reforming catalyst zones under effective reforming conditions and in the presence of hydrogen,
   (c) introducing the low boiling fraction as part of the feed to the last or the penultimate of the reforming catalyst zones, and
   (d) recovering from said last reforming catalyst zone a product effluent having a BTX composition substantially higher than if said naphtha were catalytically reformed with substantially the same catalyst under substantially the same reforming conditions.

2. A process according to claim 1 wherein the naphtha has a boiling range between about 100° and about 430° F.

3. A process according to claim 1 wherein the cut point range in step (a) is between about 200° and about 350° F.

4. A process according to claim 1 wherein the cut point in step (a) is substantially the mid-boiling point of said naphtha.

5. A process according to claim 1 wherein the reforming catalyst comprises platinum on an inorganic metal oxide support.

6. A process according to claim 5 wherein the reforming catalyst additionally comprises a metal promoter selected from the group consisting of rhenium, iridium and tin.

7. A process according to claim 5 wherein the inorganic metal oxide comprises alumina.

8. A process according to claim 1 wherein the catalyst is provided as a fixed bed in the reforming catalyst zones.

9. A process according to claim 1 wherein the catalyst is provided as a moving bed in the reforming catalyst zones.

10. A process according to claim 1 wherein three, four or five reforming catalyst zones are employed.

11. A process according to claim 1 wherein the low boiling fraction of step (c) is introduced into the last of the reforming catalyst zones.

12. A process according to claim 1 wherein the low boiling fraction of step (c) is introduced into the penultimate of the reforming catalyst zones.

* * * * *